US011078776B2

(12) United States Patent
Wallace

(10) Patent No.: US 11,078,776 B2
(45) Date of Patent: Aug. 3, 2021

(54) CALIPER-ARM RETENTION SYSTEM

(71) Applicant: Probe Technology Services, Inc., Fort Worth, TX (US)

(72) Inventor: Frank Wallace, Tomball, TX (US)

(73) Assignee: Probe Technology Services, Inc., Fort Worth, TX (US)

( * ) Notice: Subject to any disclaimer, the term of this patent is extended or adjusted under 35 U.S.C. 154(b) by 0 days.

(21) Appl. No.: 16/787,128

(22) Filed: Feb. 11, 2020

(65) Prior Publication Data

US 2020/0263532 A1 Aug. 20, 2020

Related U.S. Application Data

(60) Provisional application No. 62/807,657, filed on Feb. 19, 2019.

(51) Int. Cl.
*E21B 47/01* (2012.01)
*E21B 47/08* (2012.01)

(52) U.S. Cl.
CPC ..... *E21B 47/01* (2013.01); *E21B 47/08* (2013.01)

(58) Field of Classification Search
CPC ..... E21B 47/01; E21B 47/08
USPC ..... 33/544.3
See application file for complete search history.

(56) References Cited

U.S. PATENT DOCUMENTS

| | | | | |
|---|---|---|---|---|
| 2,680,913 | A | 8/1951 | Johnston et al. | |
| 2,853,788 | A | 9/1958 | Kinley | |
| 9,273,945 | B2 * | 3/2016 | Lewis | G01B 5/00 |
| 10,605,582 | B2 * | 3/2020 | Ohmer | G01B 3/26 |
| 2014/0059874 | A1 * | 3/2014 | Sallwasser | E21B 47/08 33/544.3 |
| 2018/0172418 | A1 * | 6/2018 | Ohmer | G01B 5/12 |
| 2020/0263532 | A1 * | 8/2020 | Wallace | E21B 47/01 |

OTHER PUBLICATIONS

PCT/US20/17589 International Search Report dated Apr. 24, 2020.

* cited by examiner

*Primary Examiner* — Yaritza Guadalupe-McCall
(74) *Attorney, Agent, or Firm* — D. Tiller Law PLLC; Donald Tiller

(57) ABSTRACT

A caliper-arm-retention mechanism for a caliper tool is disclosed. The retention mechanism includes a selectively movable retention sleeve and a pivot arm that cooperate to constrain relative translational motion between the pivot arm and a caliper arm pivotally engaged with the pivot arm while at the same time allowing relative rotational movement of the caliper arm and pivot arm. The retention sleeve may be selectively repositioned using a threaded nut configured to push the sleeve toward the pivot arm or pull the sleeve away from the pivot arm, depending on the direction of rotation of the nut.

6 Claims, 9 Drawing Sheets

CALIPER-ARM RETENTION SYSTEM

CROSS-REFERENCE TO RELATED APPLICATIONS

This application claims priority to U.S. Patent Application No. 62/807,657, filed on Feb. 19, 2019.

TECHNICAL FIELD

This invention pertains generally to technology for caliper tools that may be used to measure geometric aspects of tubulars or a wellbore. More particularly, the invention pertains to technology to retain caliper arms (aka fingers) in a caliper tool while easing installation and replacement of the arms as part of the manufacture, maintenance, or repair of the tool.

BACKGROUND

Caliper tools are often used in the oil-and-gas industry to measure characteristics of the wellbore environment. For example, a multi-arm caliper logging tool may be positioned in a wellbore (e.g., via wireline) to measure the diameter of the wellbore at various depths in the wellbore. The diameter measurement may be taken at various axes to provide a diameter profile. When positioned in a tubular, such as casing in a wellbore, the caliper tool provides information about the condition of the inner wall of the tubular. An overview of caliper tools is provided in Applicant's U.S. Pat. No. 10,087,740, the entirety of which patent is incorporated herein by reference.

Generally, the arms of a caliper tool are configured to pivotally attach to a tool body. One end of the arm is pivotally attached to the tool. The other end of the arm extends out from the body of the tool until it encounters a surface (e.g., the inside wall of casing disposed in a wellbore). With arms extended, the caliper tool is sequentially positioned within that being measured (e.g., wellbore, tubular). For example, for a caliper logging tool disposed within casing in a wellbore via a line (e.g., wireline or slickline), the tool is sequentially positioned by pulling on the line and dragging the arms along the surface. As such, caliper arms are exposed to wear and tear.

The circumferential resolution of a caliper tool may be increased by increasing the number of caliper arms. For example, a 60-arm caliper tool has a greater circumferential resolution than a 40-arm caliper tool which has a greater circumferential resolution than a 24-arm caliper tool. This increased circumferential resolution comes at a cost. Namely, more caliper arms need to be installed on the tool and more caliper arms need to be replaced due to the wear and tear on the tool. Installation and replacement of the caliper arms can be a time-consuming and laborious process. Thus, increasing the number of caliper arms increases the labor costs associated with manufacturing and maintaining the caliper tool. Accordingly, there is a need for a pivotal caliper-mounting mechanism that eases the processes of installing and replacing caliper arms.

SUMMARY

The present invention is directed to technology to satisfy the need for a caliper-arm-retention mechanism that secures pivotally-mounted caliper arms to a caliper tool during operation while easing replacement or installation of the caliper arms on the tool.

In one aspect of the invention, a caliper tool includes one or more caliper arms each having a pivot feature configured to pivotally engage a pivot arm mounted to the tool. The tool further includes a retention sleeve that may be selectively positioned relative to the pivot arm. In one position of the retention sleeve, a surface of the sleeve engages a surface of the pivot feature of the caliper arm to hold the caliper arm in translational position relative to the pivot arm while allowing rotational (pivotal) movement of the caliper arm relative to the pivot arm. In another position of the retention sleeve, the pivot-feature-engaging surface is sufficiently distant from the pivot arm that the caliper arm may be disengaged from the pivot arm to allow removal (or installation) of the caliper arm. In one aspect of the invention, the retention sleeve may be selectively positioned by a threaded nut that when rotated in one direction moves the sleeve toward the pivot arm and that when rotated in the another direction moves the sleeve away from the pivot arm.

BRIEF DESCRIPTION OF THE DRAWINGS

These and other features, aspects, and advantages of the present invention will be better understood with reference to the following description, appended claims, and accompanying drawings where:

DETAILED DESCRIPTION

Figure 1:
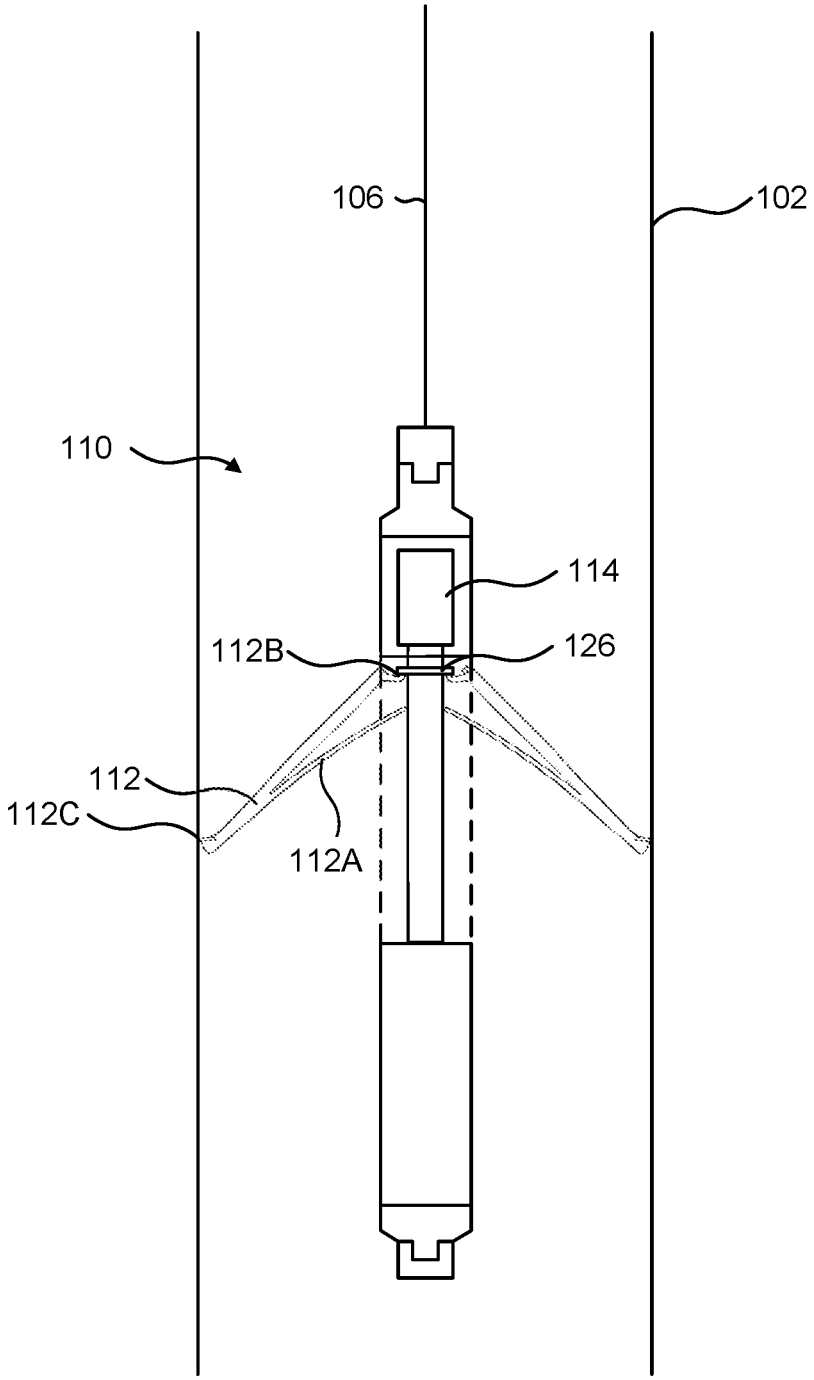
FIG. 1 depicts an exemplary caliper tool disposed in a wellbore via wireline.

In the summary above, and in the description below, reference is made to particular features of the invention in the context of exemplary embodiments of the invention. The features are described in the context of the exemplary embodiments to facilitate understanding. But the invention is not limited to the exemplary embodiments. And the features are not limited to the embodiments by which they are described. The invention provides a number of inventive features which can be combined in many ways, and the invention can be embodied in a wide variety of contexts. Unless expressly set forth as an essential feature of the invention, a feature of a particular embodiment should not be read into the claims unless expressly recited in a claim.

Except as explicitly defined otherwise, the words and phrases used herein, including terms used in the claims, carry the same meaning they carry to one of ordinary skill in the art as ordinarily used in the art.

Because one of ordinary skill in the art may best understand the structure of the invention by the function of various structural features of the invention, certain structural features may be explained or claimed with reference to the function of a feature. Unless used in the context of describing or claiming a particular inventive function (e.g., a process), reference to the function of a structural feature refers to the capability of the structural feature, not to an instance of use of the invention.

Except for claims that include language introducing a function with "means for" or "step for," the claims are not recited in so-called means-plus-function or step-plus-function format governed by 35 U.S.C. § 112(f). Claims that include the "means for [function]" language but also recite the structure for performing the function are not means-plus-function claims governed by § 112(f). Claims that include the "step for [function]" language but also recite an act for performing the function are not step-plus-function claims governed by § 112(f).

Except as otherwise stated herein or as is otherwise clear from context, the inventive methods comprising or consisting of more than one step may be carried out without concern for the order of the steps.

The terms "comprising," "comprises," "including," "includes," "having," "haves," and their grammatical equivalents are used herein to mean that other components or steps are optionally present. For example, an article comprising A, B, and C includes an article having only A, B, and C as well as articles having A, B, C, and other components. And a method comprising the steps A, B, and C includes methods having only the steps A, B, and C as well as methods having the steps A, B, C, and other steps.

Terms of degree, such as "substantially," "about," and "roughly" are used herein to denote features that satisfy their technological purpose equivalently to a feature that is "exact." For example, a component A is "substantially" perpendicular to a second component B if A and B are at an angle such as to equivalently satisfy the technological purpose of A being perpendicular to B.

Except as otherwise stated herein, or as is otherwise clear from context, the term "or" is used herein in its inclusive sense. For example, "A or B" means "A or B, or both A and B."

An exemplary caliper tool is depicted in FIG. 1. The caliper tool 110 is shown disposed in casing 102 via a wireline 106. The wireline 106 mechanically attaches the caliper tool 110 to a surface system, as is well known in the art. The caliper tool 110 includes a number of caliper arms 112. The caliper arms 112 are pivotally connected to the body of the tool 110 through a pivot collar 126 on the tool 110 and a corresponding pivot feature 112B on the caliper arms 112. A spring feature 112A of the caliper arms 112 pushes the caliper arms 112 away from the body of the tool 110. A sensor section 114 is connected to the caliper arms 112 to convert the radial positions of the tips 112C of the caliper arms 112 into electronic or magnetic signals that are collected and processed to provide geometric information regarding the inside surface of the casing 102.

Figure 2:
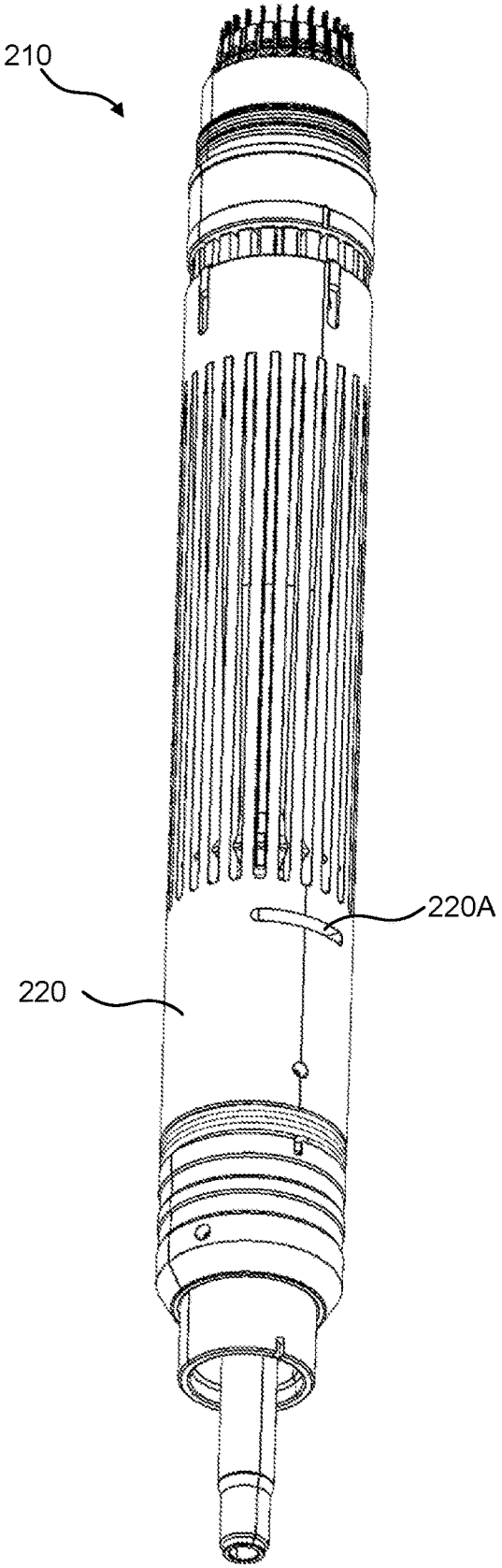
FIG. 2 is a perspective view of a portion of an exemplary caliper tool implementing an aspect of the invention.
Figure 3:
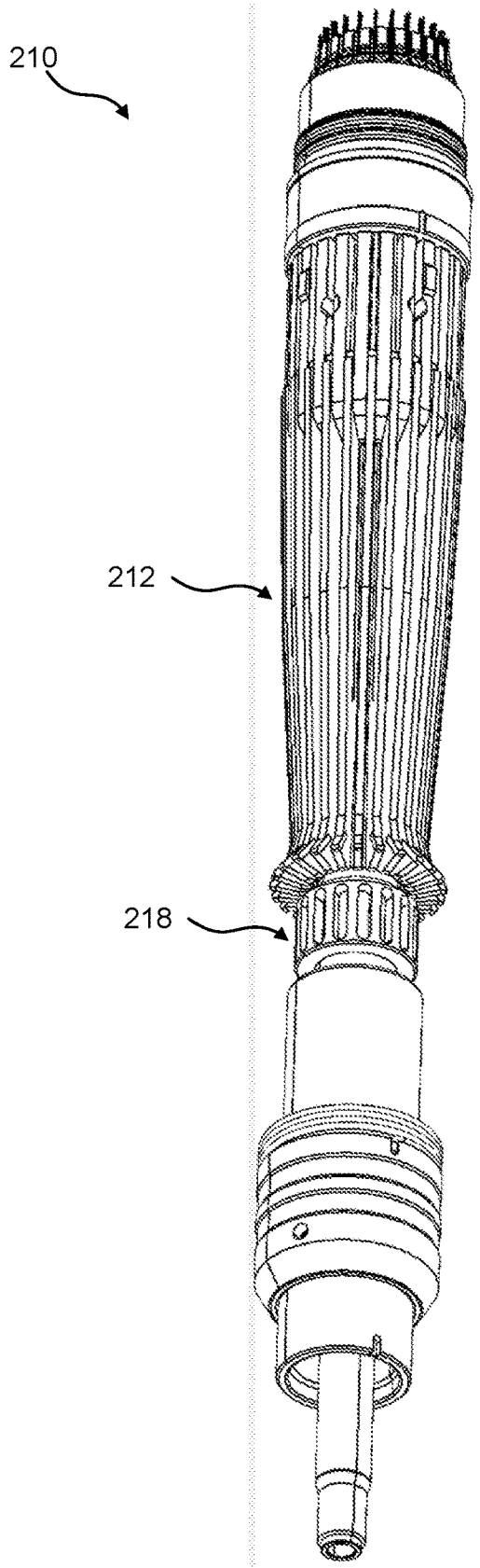
FIG. 3 is a perspective view of a portion of an exemplary caliper tool implementing an aspect of the invention.

A portion of an exemplary caliper tool 210 is depicted in FIGS. 2 and 3. In FIG. 2, an actuator sleeve 220 is disposed over a number of retained caliper arms 212. For sake of clarity, the actuator sleeve 220 is not shown in FIG. 3. The tool 210 includes a threaded adjustment nut 218 that is configured to selectively trap or release the caliper arms 212 at a pivot mount on the tool 210 (as is described below). The actuator sleeve 220 includes a slot 220A to allow access to the adjustment nut 218 when the sleeve 220 is installed on the tool 210.

Figure 4:
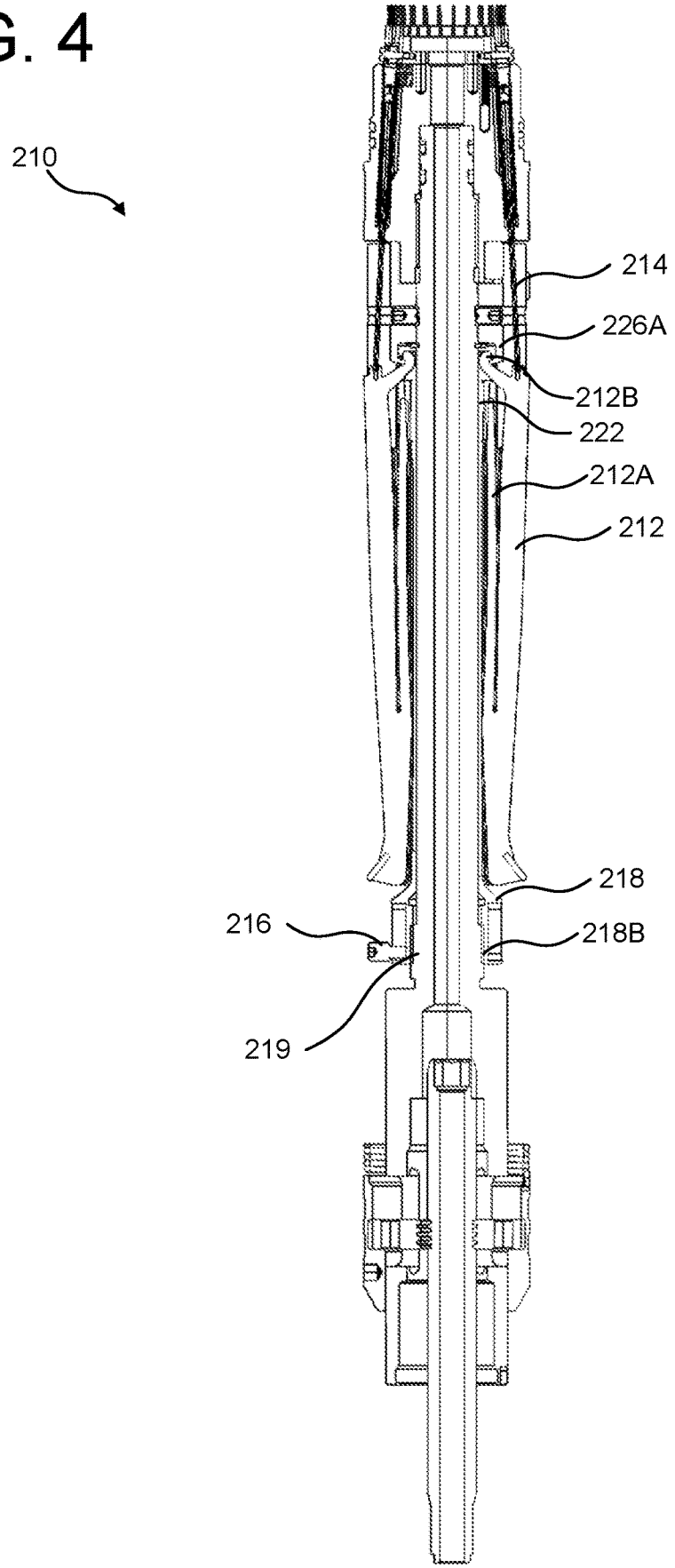
FIG. 4 is a sectional view of the exemplary caliper tool depicted in FIG. 3.

A section view of the caliper tool 210 is depicted in FIG. 4. Caliper arms 212 are shown pivotally mounted to the tool 210 at a pivot arm 226A of the tool 210 via pivot features 212B of the caliper arms 212. Here, the caliper springs 212A are shown compressed. The caliper arms 212 are connected to a sensor(s) (not shown) via an actuator rod 214. The caliper arms 212 are held in position relative to the pivot arm 226A using a longitudinally movable caliper-arm-retaining sleeve 222. The caliper-arm retaining sleeve 222 is mechanically linked to the adjustment nut 218. The adjustment nut 218 engages a threaded feature 219 of the tool 210 via nut threads 218B. Threaded rotation of the nut 218 causes the nut 218 to move toward or away from the pivot arm 226A, depending on the direction of the rotation. Thus, the nut 218 can be used to position the retaining sleeve 222 to hold the caliper arms 212 on the pivot arm 226A and it can be used to position the retaining sleeve 222 to release the caliper arms 212 from the pivot arm 226A. A set screw 216 is used to lock the adjustment nut 218 in place to hold the caliper arms 212 to the pivot arm 226A for operation of the tool 210.

Figure 5:
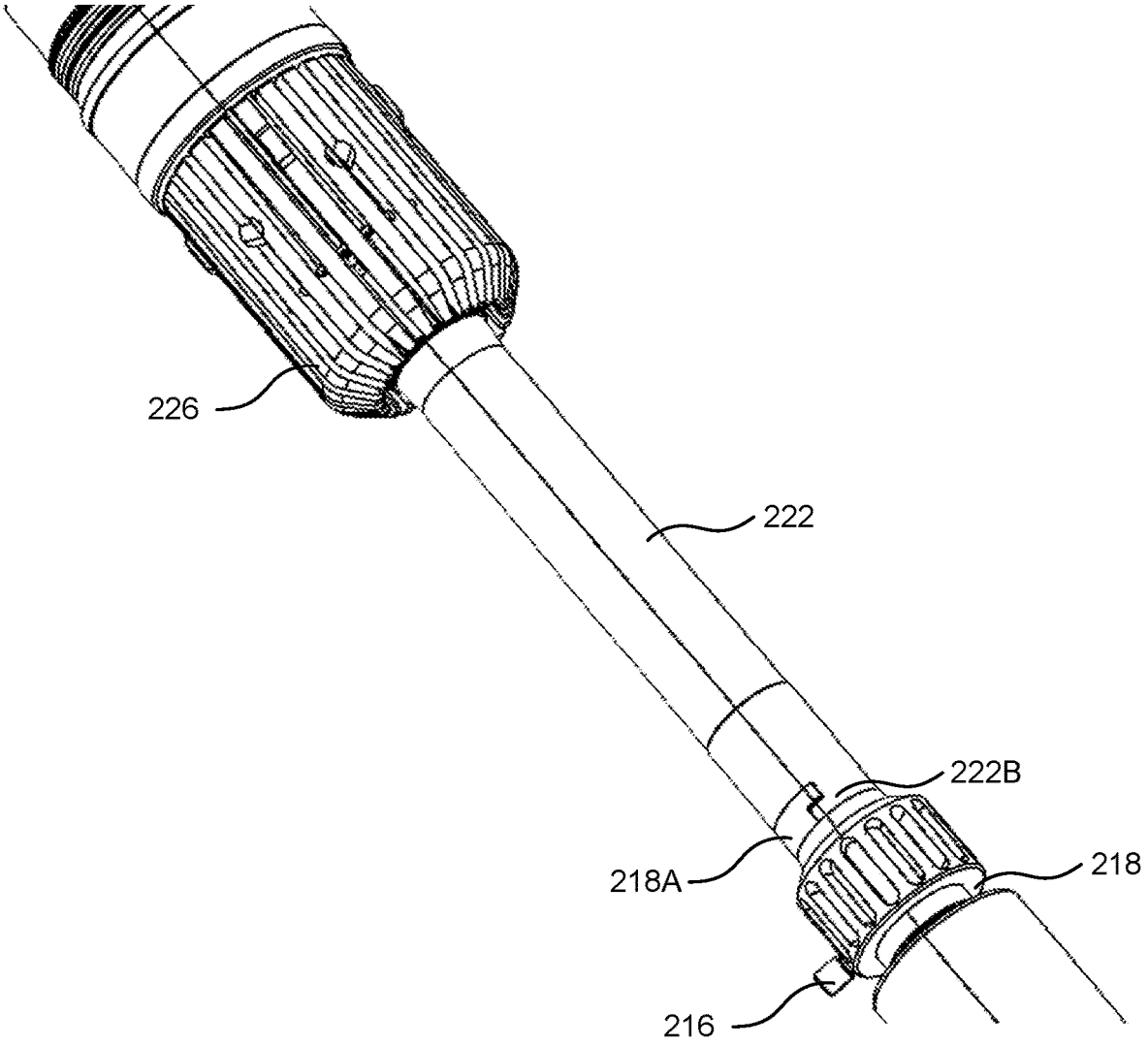
FIG. 5 is a perspective view of a portion of an exemplary caliper tool and depicts an exemplary caliper retention mechanism according to an aspect of the invention.
Figure 6:
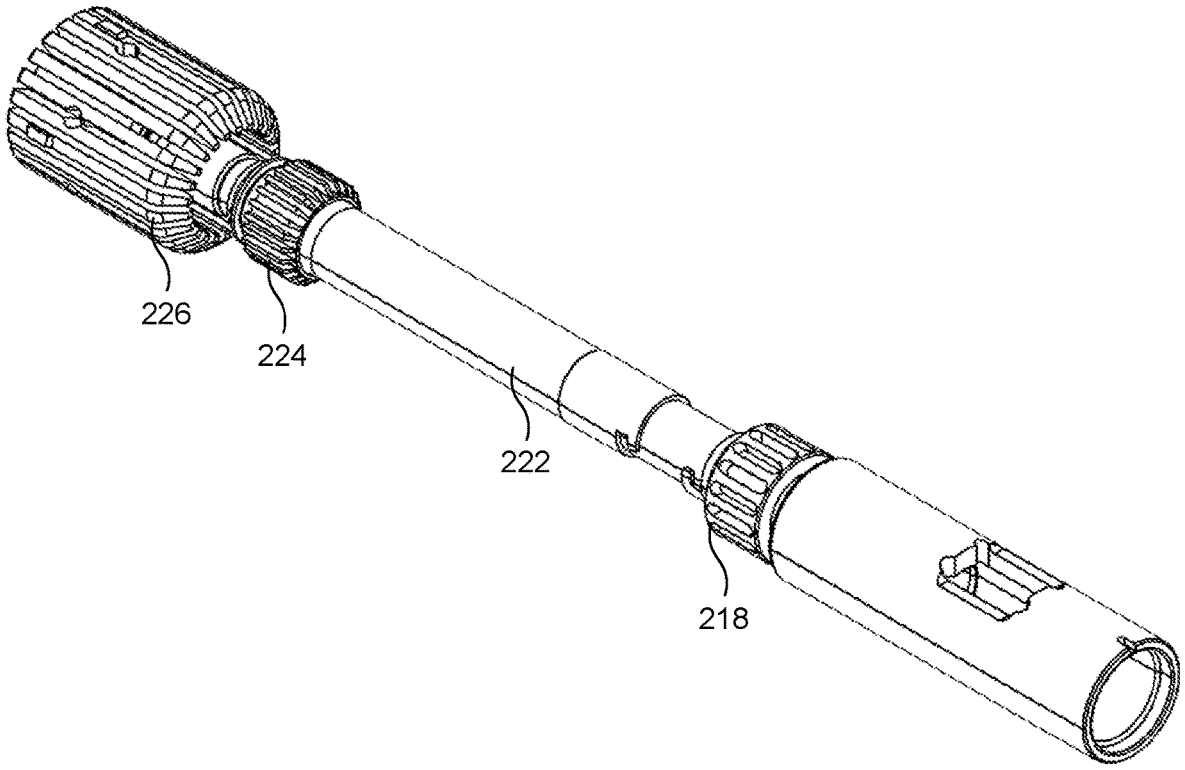
FIG. 6 is a partially-exploded perspective view of a portion of an exemplary caliper tool and depicts an exemplary caliper retention mechanism according to an aspect of the invention.
Figure 7:
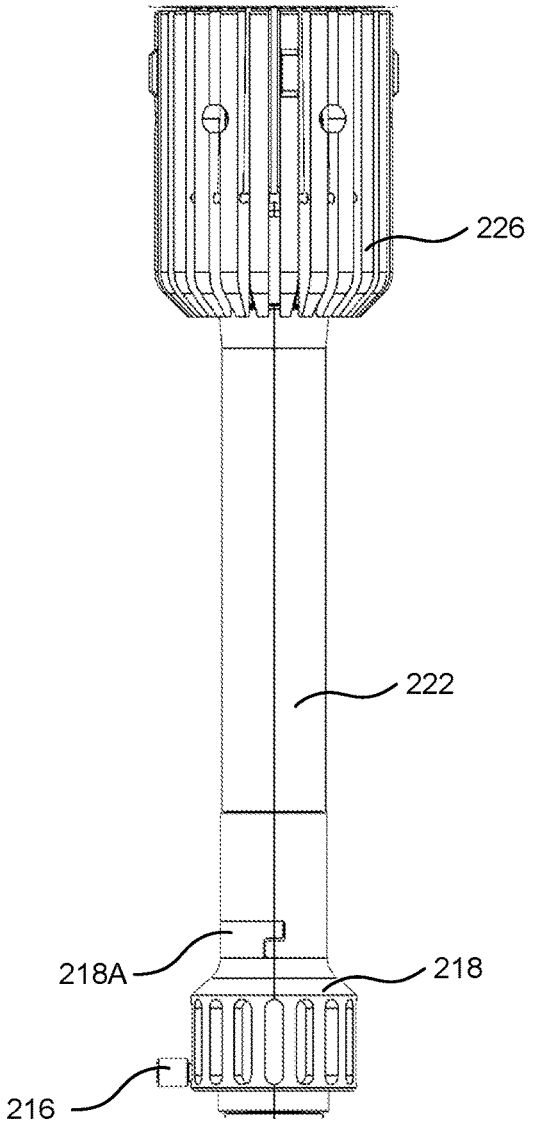
FIG. 7 is a side view of a portion of an exemplary caliper tool and depicts an exemplary caliper retention mechanism according to an aspect of the invention.
Figure 8:
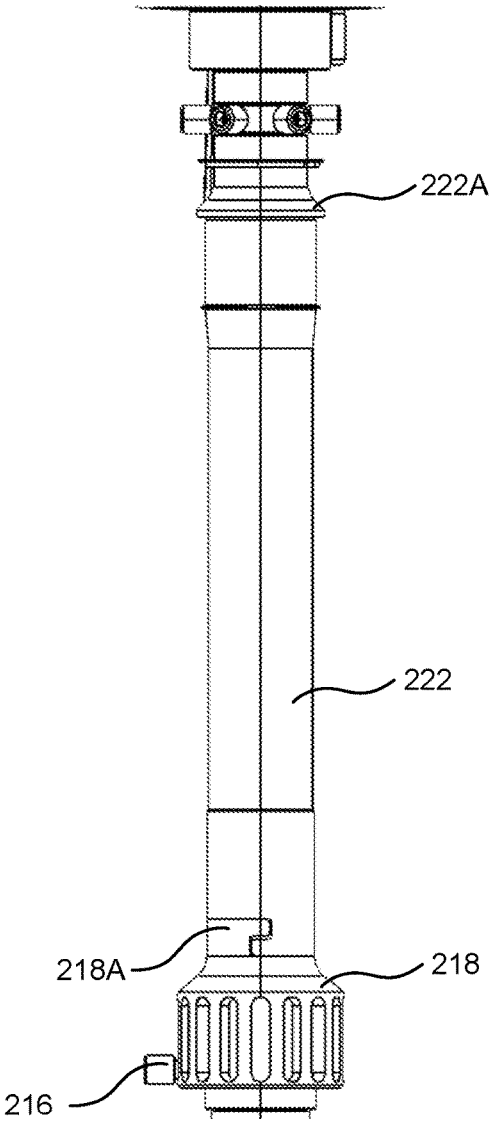
FIG. 8 is a side view of a portion of an exemplary caliper tool and depicts an exemplary caliper retention mechanism according to an aspect of the invention.

A portion of the caliper-retention mechanism of the caliper tool 210 is shown in FIG. 5. The pivot collar 226, the caliper-arm-retaining sleeve 222, the adjustment nut 218, and the screw 216 cooperate to selectively retain or release the caliper arms 212. The pivot arm 226A is a feature of the pivot collar 226. The adjustment nut 218 is linked to the retaining sleeve 222 via complementary features 218A, 222B on the nut 218 and sleeve 222. The mechanism depicted in FIG. 5 is further depicted in the partially-exploded view of FIG. 6 which further shows a caliper-arm guide 224. FIGS. 7 and 8 are side views of the caliper-retention mechanism. As shown in FIG. 8, the retaining sleeve 222 includes a retention-ramp surface 222A configured to engage a surface of the caliper arm 212 when installed.

Figure 9:
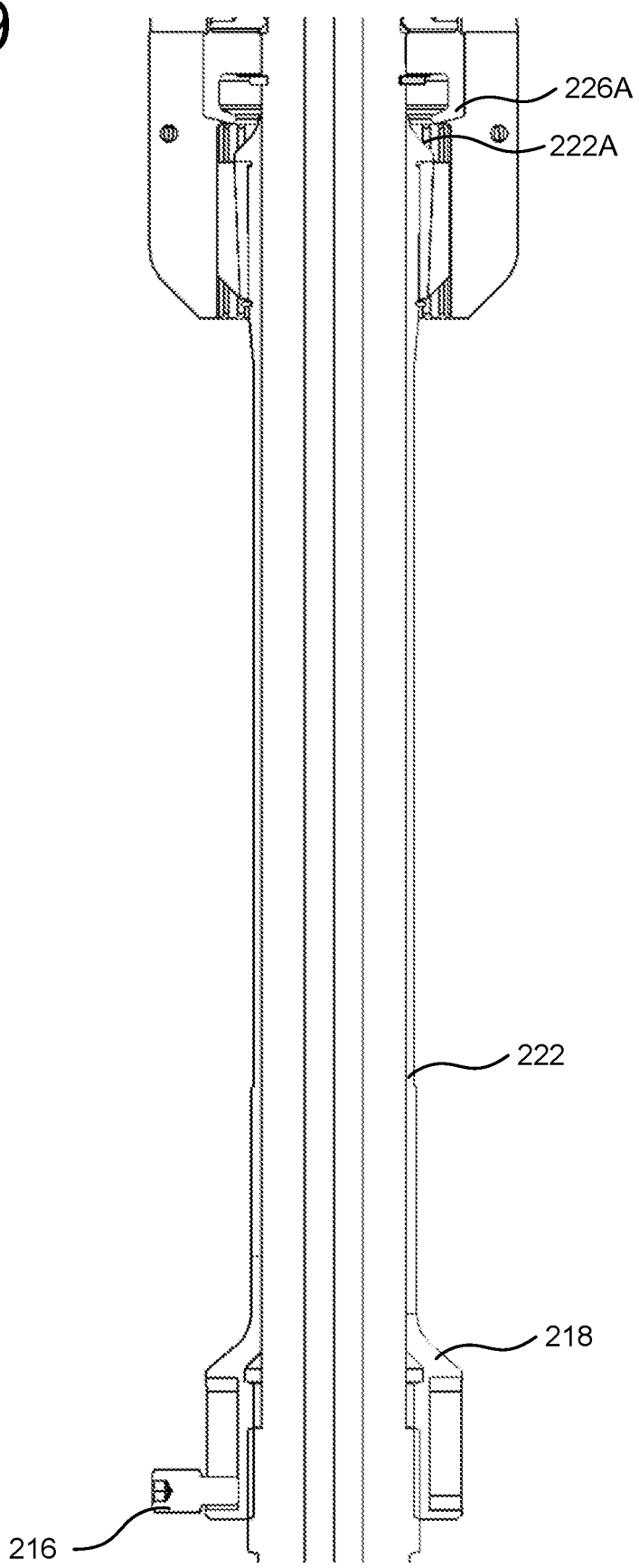
FIG. 9 is a section view of a portion of an exemplary caliper tool and depicts an exemplary caliper retention mechanism according to an aspect of the invention.
Figure 10:
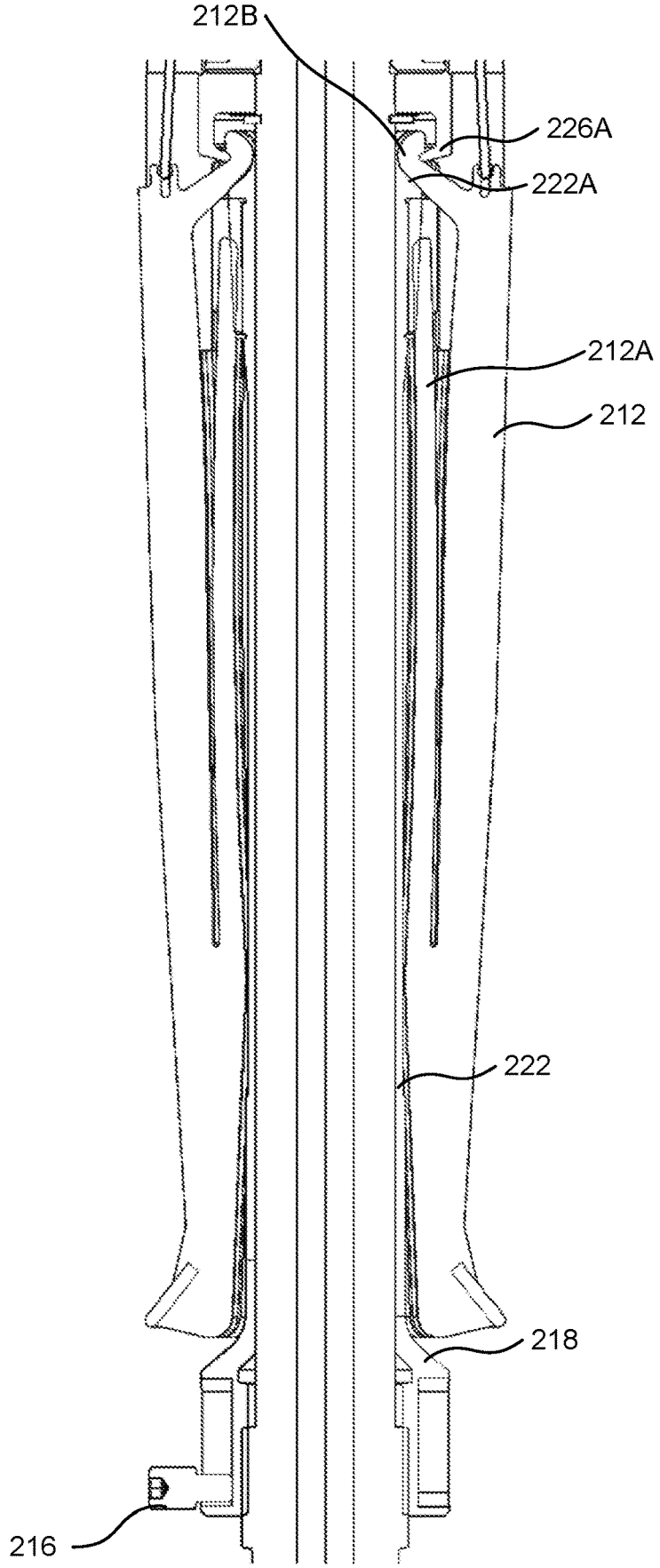
FIG. 10 is substantially the section view of FIG. 9 but also depicting caliper arms as installed.

FIG. 9 is a section view of the caliper-retention mechanism with retaining sleeve 222 shown in position to hold caliper arms (not shown) on pivot arm 226A. FIG. 10 is a section view depicting the caliper arms 212 retained by the retaining sleeve 222 and pivot arm 226A. The retaining sleeve 222 is positioned via the adjustment nut 218 such that the retention-ramp surface 222A engages a corresponding surface of the pivot feature 212B of the caliper arm 212 sufficiently to hold the pivot feature 212B on the pivot arm 226A and yet allow the caliper arm 212 to pivot at the pivot arm 226A.

Figure 11:
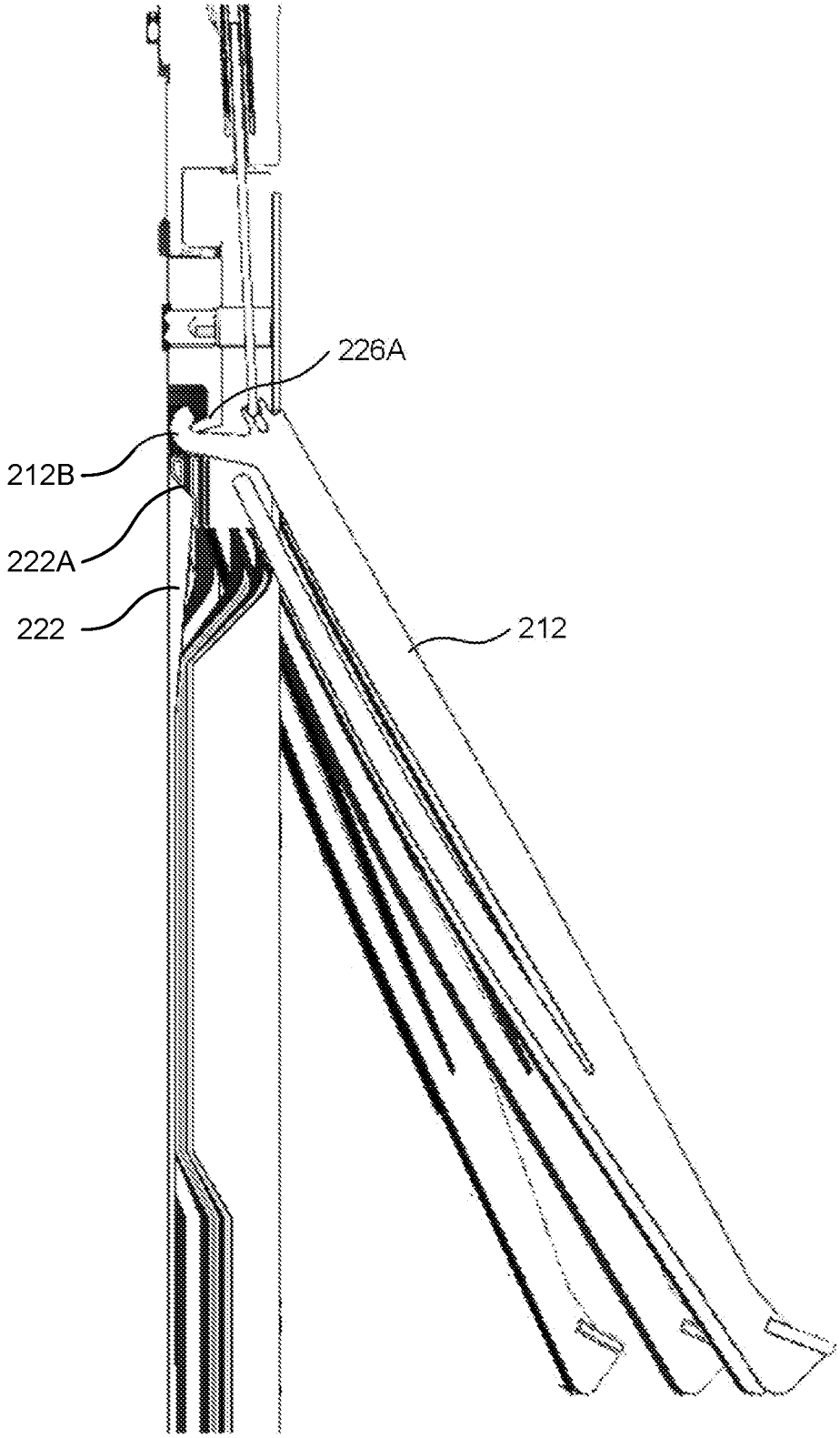
FIG. 11 is a section view of a portion of an exemplary caliper tool and depicts a caliper arm being installed into an exemplary caliper retention mechanism according to an aspect of the invention.

FIG. 11 is a section view depicting the retaining sleeve 222 positioned to release the caliper arms 212 from engagement with the pivot arm 226A. The springs 212A of the caliper arms 212 are shown compressed (this could be accomplished, e.g., using a wrench during installation or removal of the caliper arms 212). To install or remove a caliper arm 212, the retaining sleeve 222 is moved longitudinally away from the pivot arm 226A (via adjustment nut 218) to create a gap between the pivot arm 226A and the retention-ramp surface 222A. The caliper arm may be moved radially in on the tool (left, in the figure) in the gap between the pivot feature 212B and the pivot arm 226A. This then allows longitudinal movement of the caliper arm 212 to engage the pivot arm 226A (installing the caliper arm 212) or to disengage the pivot arm 226A (removing the caliper arm). Once the caliper arms 212 are installed on the pivot arm 226A, the retaining sleeve 222 may be repositioned (via adjustment nut 218) so as to lessen the gap between the retention-ramp surface 222A and the pivot arm 226A and thereby hold the caliper arm 212 on the pivot arm 226A (as shown, e.g., in FIG. 10).

While the foregoing description is directed to the preferred embodiments of the invention, other and further embodiments of the invention will be apparent to those skilled in the art and may be made without departing from the basic scope of the invention. And features described with reference to one embodiment may be combined with other embodiments, even if not explicitly stated above, without departing from the scope of the invention. The scope of the invention is defined by the claims which follow.

The invention claimed is:

1. A caliper tool comprising:

(a) a cylindrical chassis having a longitudinal axis;

(b) at least one caliper arm having a first end and a second end, wherein the first end includes a hooked portion and a sloped portion;

(c) a pivot collar disposed on the cylindrical chassis, wherein the pivot collar includes a pivot arm having a hooked portion shaped to engage the hooked portion of the caliper arm;

(d) a retention sleeve disposed on the cylindrical chassis, wherein the retention sleeve has a first end and a second end and wherein the first end of the retention sleeve includes a sloped portion configured to engage the sloped portion of the caliper arm;

(e) a positioning collar disposed on the cylindrical chassis, wherein the positioning collar has a first end and a second end and wherein the first end of the positioning collar is configured to abut the second end of the retention sleeve.

2. The caliper tool of claim 1 wherein the positioning collar is selectively translocatable along the longitudinal axis.

3. The caliper tool of claim 2 wherein:

(a) the positioning collar includes a threaded portion; and (b) the cylindrical chassis includes a threaded portion complementary to the threaded portion of the positioning collar.

4. The caliper tool of claim 2 wherein the positioning collar may be placed at a first position along the longitudinal axis to force the retention sleeve to engage the caliper arm and may be placed at a second position along the longitudinal axis to allow the retention sleeve to disengage the caliper arm.

5. The caliper tool of claim 2 further comprising a means for disabling selective translocation of the positioning collar along the longitudinal axis.

6. The caliper tool of claim 1 wherein:

(a) the first end of the positioning collar includes a hooked portion; and (b) the second end of the retention sleeve includes a hooked portion complementary to the hooked portion of the positioning collar.

* * * * *